United States Patent [19]

Bredbenner

[11] 3,945,746

[45] Mar. 23, 1976

[54] GRATING STRUCTURE FOR ROADWAY STORM DRAIN INLETS AND THE LIKE

[75] Inventor: Lee P. Bredbenner, Towson, Md.

[73] Assignee: Maryland Grading and Fabricating Company, Inc., Baltimore, Md.

[22] Filed: Jan. 27, 1975

[21] Appl. No.: 544,653

[52] U.S. Cl. ..... 404/4; 210/163

[51] Int. Cl.[2] ..... E01F 5/00

[58] Field of Search ..... 404/4, 5, 2, 25; 210/163, 210/164; 52/626, 663

[56] References Cited

UNITED STATES PATENTS

| | | | |
|---|---|---|---|
| 1,092,921 | 4/1914 | Kurz | 404/5 |
| 1,107,812 | 8/1914 | MacDonald | 404/4 |
| 1,733,923 | 10/1929 | Voskamp | 52/663 X |
| 3,263,579 | 8/1966 | Dorris | 404/26 |
| 3,773,428 | 11/1973 | Bowman | 404/26 |
| 3,815,749 | 6/1974 | Thompson | 404/4 X |

*Primary Examiner*—Nile C. Byers
*Attorney, Agent, or Firm*—Mason, Fenwick & Lawrence

[57] ABSTRACT

A rectangular grating panel to be supported in a stationary frame surrounding an opening of a storm drain inlet or the like, the grating panel having an outwardly projecting anchor leg at one side to project beneath one of the frame members of the stationary frame and having a pair of adjustable locking devices projecting from the opposite side of the grating panel to bear against an interlock beneath a confronting frame member of the stationary frame. The locking devices each include a threaded stud adjustable by threaded nuts for axial movement relative to the grating panel and a truncated angle member head on each stud providing a face to bear against the confronting frame member and a short flange to project therebeneath.

10 Claims, 6 Drawing Figures

GRATING STRUCTURE FOR ROADWAY STORM DRAIN INLETS AND THE LIKE

BACKGROUND AND OBJECTS OF THE INVENTION

The present invention relates in general to improvements in grating structures of a type in which a grating panel or pair of panels formed as a generally rectangular reticulated grating structure provides a cover at road surface level for storm drain inlets and similar type road surface openings to form a uniform traffic-bearing grating surface over which motor vehicles, bicycles and the like are adapted to travel, and more particularly to grating structures of such type having manually manipulatable adjustment and locking structure for adjustably positioning the grating transversely in the stationary supporting frame structure for the grating and including locking mechanism to be interlocked with the supporting frame for preventing and discouraging the removal of the grating structure from the drain inlet.

Replaceable grating devices in the form of rigid grating panels have been customarily employed as the roadway surface level cover for storm drain inlets spaced at intermittent locations along the curb region of highways and city streets. The road drain inlet gratings for such highway storm drain inlets and the like designed to withstand the load of automobile and bicycle traffic, have frequently been formed of cast iron grating panels adapted to be supported in the customary stationary frame at the upper inlet opening of the standard concrete storm drain inlet box, frequently having transversely spaced elongated longitudinal slot-like openings separated by rigid cast bar formations longitudinally spanning the length of the grating panel to provide a large total opening area for passage of water into the storm drain inlet box. These customary highway storm drain inlet gratings are produced with various opening patterns, but most frequently have the transversely spaced, elongated slots longitudinally spanning the grating panel with the slots either extending uninterruptedly over most of the length of the grating panel or being interrupted by a few transverse webs.

More recently, as a result of a number of bicycle accidents caused by penetration of the narrower style bicycle tires in current vogue into the slots or passages in the cast highway inlet gratings of the elongated slotted design, replacement of the slotted design gratings with reticular gratings having smaller nonelongated openings which would provide greater bicycle safety has been undertaken in many areas. Similar reticular gratings, formed of parallel longitudinal bearing bars and intermediate crimped strips, have been used as decking for traffic-bearing surfaces such as bridges, elevated highways, sidewalk covers for below ground ventilating inlets and freight access tunnels, or reticulated flooring sections in industrial plants. The need to remove large numbers of the road drain inlet gratings from their supporting frames and replace them with grating structures of other designs has increased awareness of the need for improvement in the means for anchoring or fastening such grating structures in place to prevent or discourage the removal of the grating by unauthorized personnel. Typically, it has been recommended for positive fastening and easy, rapid installation of conventional reticulated gratings that the bearing bars be spot welded at various locations to the supporting angle iron structure or other supporting frame. Of course such spot welded fastening techniques for gratings make it a difficult, time-consuming and expensive procedure to remove the grating when its removal and replacement is called for. Where it is recognized that periodic removal of the grating may be required, some have proposed various types of locking devices such as shouldered slotted slide plates secured by bolt and nut fasteners to the grating, or clip type or bendable fastening devices secured by screws or bolts to the grating to interfit with or against various surface formations of the associated supporting frame and fasten the grating against removal. Frequently, these anchoring devices include portions which protrude upwardly above the upper traffic-bearing surface formed by the grating structure, thus providing undesirable characteristics.

Also, some specifications for grating panel structures for highway storm drain inlets require that the grating panel structure include some kind of adjustment device which may be adjustably positioned laterally outwardly from the curb side outermost longitudinal bearing bar or straight side member of the grating panel to bear against the confronting member of the stationary supporting frame surrounding the inlet opening of the storm drain inlet to enable the grating panel to be inserted in the frame and adjustably positioned laterally to the desired position in the frame. This adjusting device sometimes is a required feature of grating panels for storm drain inlets to facilitate the installation and removal of the grating panels.

An object of the present invention is the provision of a novel grating panel structure for the framed inlet opening of conventional highway storm drain inlets and the like, wherein the grating structure includes a stationary outwardly projecting anchoring leg at the road side of the grating panel to project under the associated stationary grate supporting frame of the storm drain inlet and includes an adjustable locking device at the curb side of the grating panel having a modified angle formation adjustably supported by the adjacent side member of the grating for movement outwardly toward and away from the grating side member providing a bearing face to abut the inside vertical face of the associated stationary frame and providing another leg to project under the adjacent stationary frame portion to anchor the grating in position against unauthorized or accidental removal.

Another object of the present invention is the provision of a novel grating panel structure as described in the immediately preceding paragraph, wherein the adjustable locking structure includes a threaded stud extending through a side bearing bar member of the grating panel having an angle iron foot member on the end thereof to bear against the confronting inside vertical face of the associated stationary frame and under the adjacent portions of the stationary frame and having adjusting nut members on the threaded stud for determining the adjusted positions of the angle foot member.

Other objects, advantages and capabilities of the present invention will become apparent from the following description, taken in conjunction with the accompanying drawings illustrating a preferred embodiment of the invention.

DETAILED DESCRIPTION OF A PREFERRED EMBODIMENT

Figure 2:
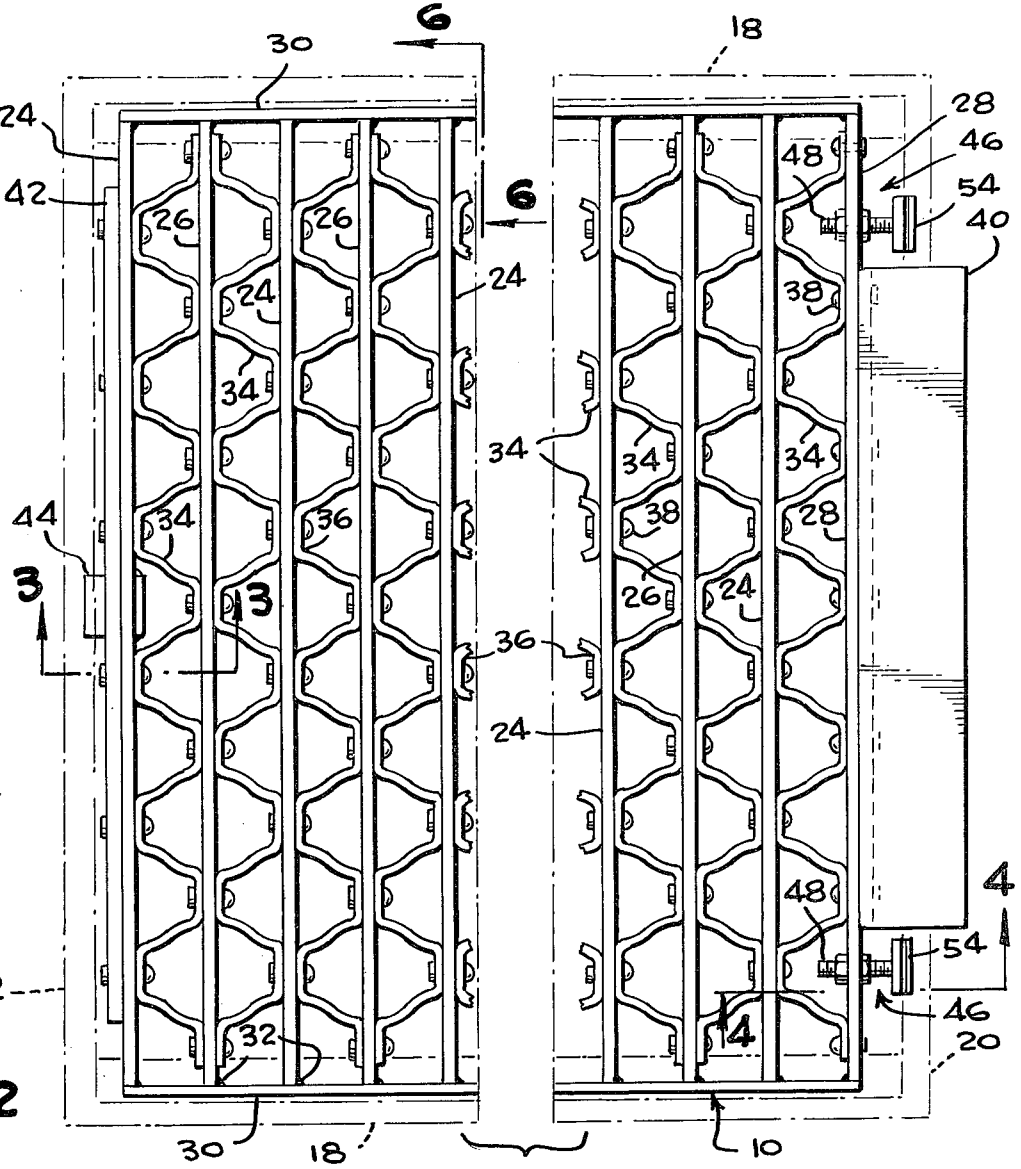
FIG. 2 is a fragmentary top plan view of the grating panel, shown to enlarged scale.
Figure 1:
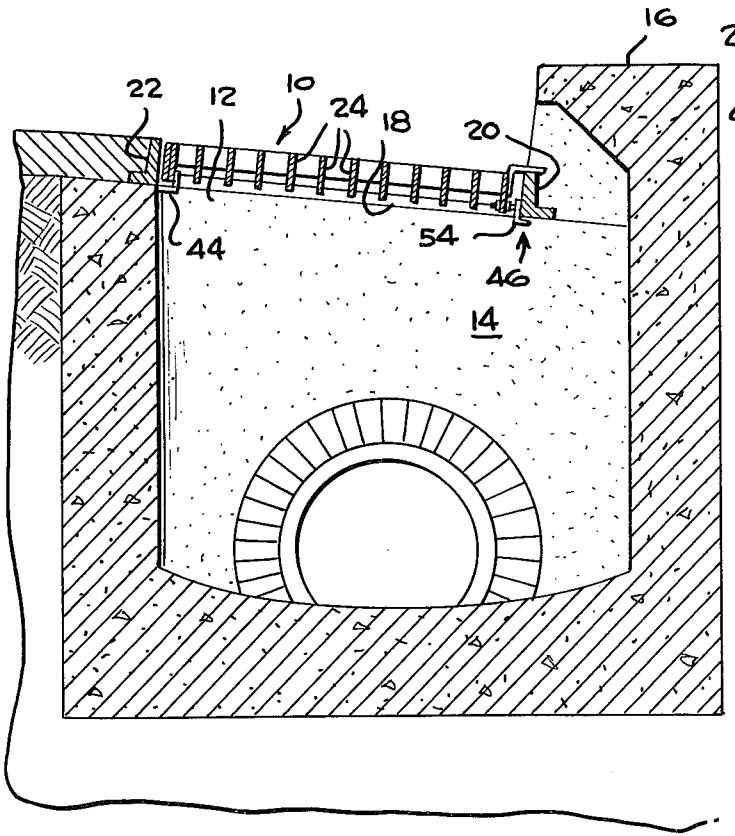
FIG. 1 is vertical transverse section view of the upper portion of a typical highway storm drain inlet and associated grating panel covering the same, wherein the grating panel is constructed in accordance with the present invention.

Referring to the drawings, wherein like reference characters designate corresponding parts throughout the several Figures, the grating panel structure of the present invention, indicated generally by the reference character 10, forms the reticular cover for the upper inlet opening, indicated by the reference character 12, of a standard highway storm drain inlet box, herein frequently referred to simply as a storm drain inlet or standard inlet. The storm drain inlet, indicated by the reference character 14, is typically constructed as a reinforced concrete or brick box usually disposed alongside the curb of the highway, indicated at 16, to provide a large upwardly facing generally rectangular inlet opening at the level of the traffic-bearing surface of the highway flanked along the curb side by a curb opening spanning the major portion of the height of the curb along the length of the grating. The inlet opening 12 of the storm drain inlet 14 is typically surrounded by a cast iron stationary frame formed of angle iron end frame members 18, curb side frame member 20 and road side frame member 22 integrally or rigidly joined together at the corners.

The grating panel 10 is formed as a reticular grating of a large number of openings of limited size and uniform configuration, having two types of straight spaced longitudinal metal bars, herein termed longitudinal bearing bars, one type of which is indicated by the reference character 24 and the other by the reference character 26. The number of the longitudinal bearing bars 24, 26 depends upon the width of the grating panel desired and the length of the bars also depends upon the length of the panel desired. Although a typical grating panel may be in the form of a rectangle which is about 2 ft. 8¾ inches in length and about 2 ft. 5⅞ inches in width, having six longitudinal bearing bars 24 and five longitudinal bearing bars 26, and one curb side longitudinal bearing bar 28, only nine of the longitudinal bearing bars are shown in FIG. 2. Each of the three types of longitudinal bearing bars 24, 26 and 28 are of like profile and external dimensions, but differ in the location of rivet holes therein, the rivet holes 24*a*for the longitudinal bearing bars 24 being located in offset or alternating relation relative to the rivet holes 26*a* of the longitudinal bearing bars 26. The curb side longitudinal bearing bar 28 has rivet holes 28 *a* located in the same manner as the rivet holes 26*a* of the longitudinal bearing bar 26 and additionally includes two holes 28*b* which are approximately nine-sixteenths inch in diameter in the lower region of the bearing bar 28 for the adjustable locking device to be later described.

In the illustrated embodiment, the ends of the longitudinal bearing bars 24, 26 and 28 are welded to end trim bars 30, by welds for example, at the inner surface of the four corners of the rectangular grating structure and along one side of the opposite ends of the longitudinal bearing bars 24 and 26, as indicated at 32.

Interposed between the longitudinal bearing bars 24, 26 and 28 are crimped metal strips 34 forming what may be termed the crimped reticuline bars of the grating, which are of the same length as each other and of such length, when bent to the distorted sinusoidal or zigzag pattern illustrated, that the respective ends thereof terminate in transverse alinement close to but slightly spaced from the two opposite end trim bars 30. The crimped reticuline bars 34 are each provided with flat, equidistantly spaced bar-contacting flat portions 36, each of which is secured to its adjacent longitudinal bearing bar by a rivet 38 in the illustrated embodiment. It will be appreciated that welding, or other types of fastening means may be employed instead of rivets at the locations where the bar-contacting formations 36 are joined to the bearing bars, if desired.

The straight bearing bars 24, 26 and 28 are of greater depth than the crimped reticuline bars 34, but the top edges of the bearing bars and the reticuline bars are on the same plane, and the reticuline bars and bearing bars coact to form an even mesh surface for traffic-bearing purposes wherein the openings are sufficiently small to prevent any significant penetration of the openings by narrow bicycle tires and the like.

In one illustrative example, the longitudinal bearing bars 24, 26 and 28, the transverse end trim bars 30, and the crimped reticuline bars 34 may all be formed from steel flat bar stock. For example, the bearing bars may be about three-eighths in. thick by 3½ inches in height, with the rivet holes 24*a*, 26*a* and 28*a* about thirteen thirty-seconds inch in diameter spaced about 5 inches apart on centers and located with their centers about 1 in. below the top edges of the bearing bars, and include a ½ in. rabbet or corner recess at the opposite ends thereof extending about 1⅜ in. inward from the adjacent end, to bear upon the inwardly projecting shoulder flanges of the opposite end frame members 18 of the stationary existing frame surrounding the inlet opening 12. The reticuline bars 34 may be about ¼ in. by 2 in. stock, and the transverse end trim bars 30 may be made from ¼ in. thick flat bar stock about 3 in. high and are welded to the ends of the longitudinal bearing bars as previously described.

Figure 3:
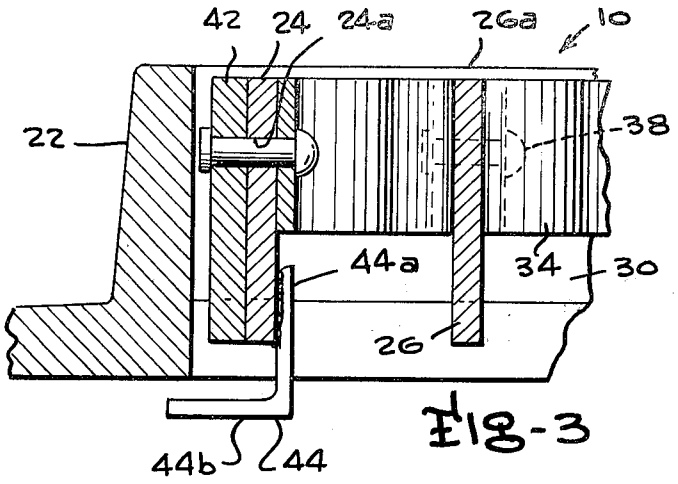
FIG. 3 is a vertical section view through the road side portion of the grating panel, taken along the line 3—3 of FIG. 2 and illustrating portions of the associated stationary supporting frame, shown to enlarged scale.
Figure 5:
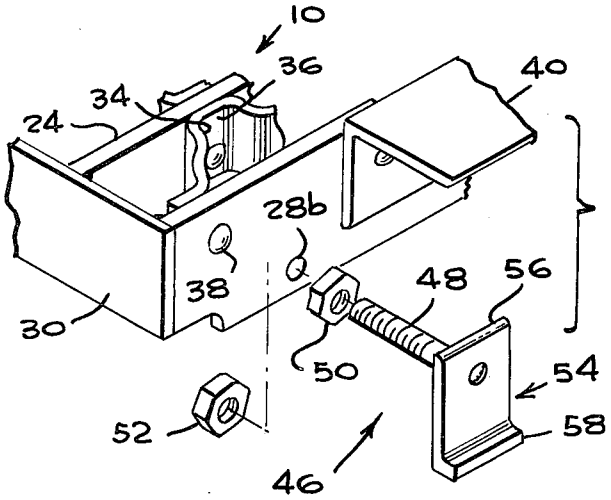
FIG. 5 is a fragmentary perspective view of the combination locking device structure and adjustment device structure shown with adjacent portions of the grating panel.

In the illustrated example, an extra safety angle member 40 formed of an angle iron having a depending vertical flange which is about 3 in. high and an outwardly projecting upper horizontal flange which extends for about 3½ in. from the curb side bearing bar 28 into the adjacent portion of the opening in the curb at a level slightly above the plane of the top edges of the bearing bars and reticuline bars to cover the space between the curb side bearing bar 28 and its confronting stationary frame member 20 and provide some protection against penetration of bicycle wheels into the curb opening at the storm drain inlet. A filler bar 42, which, for example, may be made from ½ in. thick flat bar stock 3½ in. in height, is secured by the rivets 38 flat against the outer surface of the road side exterior longitudinal bearing bar 24 to substantially fill the space between the road side exterior bearing bar 24 and the confronting surface of the road side frame member 22 when the grating is properly positioned in the inlet opening 12. A road side anchor angle member 44 is secured to the lower portion of the road side exterior bearing bar 24 near the longitudinal center thereof, for example, by welding its vertical ascending angle flange 44*a* in partially lapping relation against the inner surface of the exterior bearing bar with its horizontal outwardly projecting angle flange 44*b* spaced below the exterior bearing bar an appropriate distance to project beneath and underlap a portion of the stationary road side frame member 22 as shown in FIG. 3.

At two locations associated with the holes 28*b* in the curb side bearing bar 28 near the opposite ends thereof and flanking the extra safety angle member 40 are a pair of adjustable locking devices 46 to lock the grating structure in place in the supporting frame in such manner as to discourage or prevent easy removal of the grating structure by thieves or vandals, or other unauthorized persons, and to avoid the possibility of the grating structures popping up under the impact of traffic loads. Each of the adjustable locking devices 46 consist of an elongated threaded stud 48 extending in freely rotatable relation through the associated one of the holes 28*b* with slight clearance relative to the hole, and having threaded nuts 50 and 52 threaded thereon adjacent the opposite faces of the curb side bearing bar 28. The outer end of the stud 48 is welded or otherwise secured to an angle shaped locking head 54 having a flat vertically extending flange 56 formed, for example, of the vertical flange of an angle iron member defining a flat face to bear against the confronting inside vertical face of the curb side stationary frame member 20 and having an outwardly projecting short foot 58 formed, for example, from a shortened or truncated horizontal flange of the angle iron member, to project under the adjacent lower surface portion of the stationary curb side frame member 20 upon appropriate adjustment of the threaded nut 50 and 52 to lock the grating structure against withdrawal in coaction with the road side anchor member 44.

Figure 4:
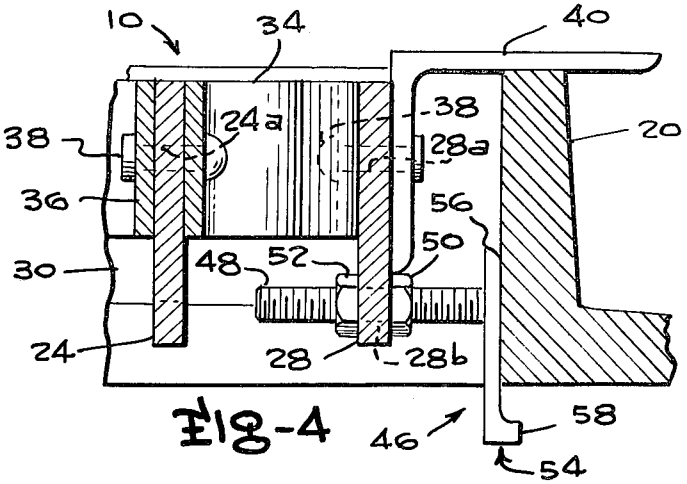
FIG. 4 is a fragmentary vertical section view through the curb side portion of the grating panel, taken along the line 4—4 of FIG. 2, showing the stationary existing frame, all shown to enlarged scale.
Figure 6:
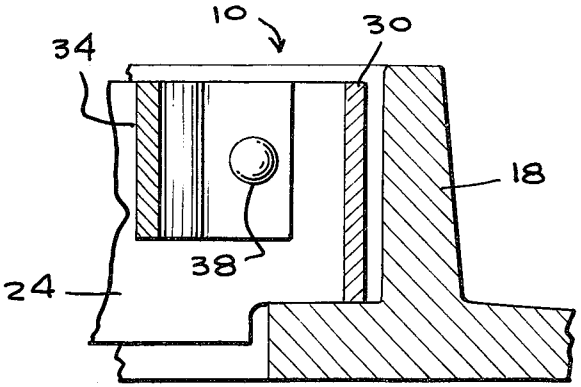
FIG. 6 is a fragmentary vertical section view through an end portion of the grating and adjacent frame portion, taken along line 6—6 of FIG. 2.

It will be apparent that movement in one direction of the adjusting nuts 50, 52 bearing against the confronting faces of the curb side bearing bar 28 causes the threaded stud 48 and locking head 54 to be drawn axially inwardly toward the center of the grate structure, or to the left as viewed in FIG. 4, thus reducing the extent of projection of the locking head 54 from the curb side bearing bar 28 and permitting the grate structure to be inserted in the stationary frame defined by the frame members 18, 20 and 22. Conversely, rotation of the adjusting nuts 50 and 52 in the opposite direction, causing them to progress toward the left-hand end of the stud 48 as viewed in FIG. 4, moves the stud 48 axially to the right as viewed in FIG. 4 causing the locking head 54 to progressively move outwardly increasing its projection from the curb side bearing bar 28 to engage the flat face of the vertical flange portion 56 against the confronting face of the curb side frame member 20 and projecting the bottom foot 58 under the frame member 20, forcing the grate structure tight to the road side of the frame and locating the projecting leg of the road side anchor member 44 under the road side frame member 22 to restrain the grate against withdrawal from the stationary frame. As one example, the locking head may be formed from a 2 in. wide section of ¼ in. thick angle iron having 2½ in. flanges, with one of the flanges foreshortened by cutting through it along a plane paralleling and spaced ½ in. from the rear surface of the other flange.

While the invention has been described above for use as the grating structure covering the inlet opening for a highway storm drain inlet, it will, of course, be understood that its use is not so limited, but that the invention may be employed in various other applications where gating structures are to be releasably locked or anchored in stationary frames for supporting the grating structure.

What is claimed is:

1. A traffic-bearing grating and adjustable locking structure to be removably secured in a rectangular stationary frame to cover a roadway opening or the like at traffic-bearing surface level, the frame having downwardly facing surface portions, comprising a generally rectangular grating panel including plural parallel longitudinal straight bearing bars including first and second outermost side bearing bars respectively adjacent and confronting first and second opposite side frame members of said stationary frame, an anchoring shoulder formation fixed on said first side bearing bar having a rigid outwardly extending leg spaced at a location slightly below the lower edge of the first side bearing bar and projecting therefrom to interfit beneath a downwardly facing surface portion of said first frame member to prevent upward withdrawal of the adjacent grating portion therefrom when so interfitted, and an adjustable locking device carried by said second side bearing bar including an axially adjustable threaded stud extending through the second side bearing bar having threaded nut means for varying the axial position of the threaded stud and an angle shaped head on said stud defining a vertical contact face to confront and contact a vertical inside surface of the second frame member and shift the first end of the grating panel toward and away from said first frame member upon axial movement of the stud by the nut means, and said angle shaped head further defining a lower foot formation projecting outwardly from said contact face to extend beneath a downwardly facing surface portion of the second frame member upon axial outward adjustment of the stud by the nut means for locking the grating panel in the stationary frame.

2. A traffic-bearing reticular grating as defined in claim 1, wherein said grating panel includes an elongated crimped reticuline bar of distorted generally zigzag shape between each adjacent parallel pair of said bearing bars having flat equidistantly spaced bar-contacting portions secured to the straight bearing bars at each point of contact therewith.

3. A traffic-bearing grating as defined in claim 1, wherein said anchoring shoulder formation is an angle iron member having a vertical upwardly projecting flange rigidly secured to the first side bearing bar and having a horizontal lower flange projecting outwardly at right angles to the vertical flange to define said outwardly extending leg.

4. A traffic-bearing reticular grating as defined in claim 2, wherein said anchoring shoulder formation is an angle iron member having a vertical upwardly projecting flange rigidly secured to the first side bearing bar and having a horizontal lower flange projecting outwardly at right angles to the vertical flange to define said outwardly extending leg.

5. A traffic-bearing grating as defined in claim 1, wherein said angle shaped head of said locking device is an angle iron member fixed to the outer end of said threaded stud having a vertical flange forming said vertical contact face and a lower foreshortened flange extending outwardly at right angles to the vertical flange and integral therewith forming said foot formation.

6. A traffic-bearing grating as defined in claim 3, wherein said angle shaped of said locking device is an angle iron member fixed to the outer end of said threaded stud having a vertical flange forming said vertical contact face and a lower foreshortened flange extending outwardly at right angles to the vertical flange and integral therewith forming said foot formation.

7. A traffic-bearing reticular grating as defined in claim 4, wherein said angle shaped head of said locking device is an angle iron member fixed to the outer end of said threaded stud having a vertical flange forming said vertical contact face and a lower foreshortened flange extending outwardly at right angles to the vertical flange and integral therewith forming said foot formation.

8. A traffic-bearing grating as defined in claim 1, wherein said grating panel includes a safety angle iron member fixed to said second side bearing bar, the safety angle member having an upper horizontal flange projected outwardly of the panel at a level just above the upper edges of the bearing bars and reticuline bars to overlie and extend beyond the second side frame member into a roadway curb drain slot or the like adjacent the stationary frame and deter accidental penetration of bicycle wheels and the like through the curb drain slot.

9. A traffic-bearing grating as defined in claim 5, wherein said grating panel includes a safety angle iron member fixed to said second side bearing bar, the safety angle member having an upper horizontal flange projected outwardly of the panel at a level just above the upper edges of the bearing bars and reticuline bars to overlie and extend beyond the second side frame member into a roadway curb drain slot or the like adjacent the stationary frame and deter accidental penetration of bicycle wheels and the like through the curb drain slot.

10. A traffic-bearing grating as defined in claim 6, wherein said grating panel includes a safety angle iron member fixed to said second side bearing bar, the safety angle member having an upper horizontal flange projected outwardly of the panel at a level just above the upper edges of the bearing bars and reticuline bars to overlie and extend beyond the second side frame member into a roadway curb drain slot or the like adjacent the stationary frame and deter accidental penetration of bicycle wheels and the like through the curb drain slot, the grating panel having two of said adjustable locking devices disposed in flanking relation to said safety angle iron member.

* * * * *